United States Patent [19]

Okamoto et al.

[11] Patent Number: 4,680,597

[45] Date of Patent: Jul. 14, 1987

[54] SELF-CONTAINED TYPE PRESSURE SENSITIVE RECORD SHEET

[75] Inventors: Shigeo Okamoto, Suita; Tomoharu Shiozaki, Amagasaki, both of Japan

[73] Assignee: Kanzaki Paper Manufacturing Co. Ltd., Tokyo, Japan

[21] Appl. No.: 763,703

[22] Filed: Aug. 8, 1985

[30] Foreign Application Priority Data

Aug. 16, 1984 [JP] Japan ..... 59-171326

[51] Int. Cl.[4] ..... B41M 5/16

[52] U.S. Cl. ..... 503/214; 503/219; 503/225; 503/226; 427/150

[58] Field of Search ..... 346/200, 214, 219, 226, 346/225; 427/150, 151, 152

[56] References Cited

U.S. PATENT DOCUMENTS 4,486,762 12/1984 Okamoto et al. ..... 346/226
4,536,220 8/1985 Kondo et al. ..... 427/151

FOREIGN PATENT DOCUMENTS 44645 1/1982 European Pat. Off. ..... 346/219

*Primary Examiner*—Bruce H. Hess
*Attorney, Agent, or Firm*—Murray and Whisenhunt

[57] ABSTRACT

A self-contained type pressure sensitive record sheet prepared by coating a substrate with a mixture of microcapsules containing a color former and an inorganic solid acid as a color acceptor and drying the resulting coating, the mixture containing 10 to 30% by weight of polyvinyl alcohol based on the weight of the inorganic solid acid.

3 Claims, No Drawings

SELF-CONTAINED TYPE PRESSURE SENSITIVE RECORD SHEET

The invention relates to a self-contained type pressure sensitive record sheet in the form of a single layer which is made less susceptible to color smudges due to contact or friction although having high color forming ability, the record sheet further having improved printability.

The self-contained type pressure sensitive record sheet is one type of pressure sensitive manifold paper wherein the color forming reaction is used between an electron donating chromogenic material (hereinafter referred to as "color former") and an electron accepting reactant material (hereinafter referred to as "color acceptor"). The record sheet is formed by coating a substrate with a layer of microcapsules enclosing oily droplets having a color former dissolved therein and with another layer of a color acceptor (usually with the color acceptor layer formed over the microcapsule layer), or by coating a substrate with a mixture of such microcapsules and color acceptor in the form of a single layer. The color former includes these of triarylmethane type, diphenylmethane type, thiazine type, spiro type, lactam type, fluoran type, etc.

Self-contained type pressure sensitive record sheets of the single layer type have advantages compared with those of the multi-layer type. Because the color former and the color acceptor are present in mixture in close proximity, they produce satisfactory records even at a low pressure. They require only one coating step and are less costly to manufacture.

However, the record sheets commercially available at present are predominantly of the multi-layer type, and those of the single layer type are only in small quantities. This is because those of the single layer type have significant defects that they easily produce color smudges when subjected to a contact, friction or the like, due to close proximity of the color former and the color acceptor.

Although many attempts are proposed to improve color smudges in such self-contained type pressure sensitive record sheet of the single layer type, the color forming ability is apt to be greatly lowered with improvement in color smudges. Thus they still remain to be greatly improved.

An object of the invention is to provide a self-contained type pressure sensitive record sheet of the single layer type having an excellent color forming ability, reduced susceptibility to color smudges when subjected to a contact, friction or the like and yet outstanding in amenability to printing.

The above and other objects of the invention will be apparent from the following description.

The present invention provides a self-contained type pressure sensitive record sheet of the single layer type prepared by coating a substrate with a mixture of microcapsules containing a color former and an inorganic solid acid as a color acceptor and drying the resulting coating, the mixture containing 10 to 30% by weight of polyvinyl alcohol based on the weight of the inorganic solid acid.

Examples of color acceptors of conventional pressure sensitive record sheets are organic color acceptors, such as phenol compounds, novolak type phenol resins, aromatic carboxylic acids or polyvalent metal salts thereof, and inorganic solid acids, such as acid clay, attapulgite, zeolite, bentonite or like natural clay minerals, or activated clay prepared by treating acid clay slightly or moderately with a mineral acid. In the present self-contained type pressure sensitive record sheet of the single layer type, the inorganic solid acids are selectively used as stated above.

Further, the objects and effects of the invention are accomplished by the use of a specific amount of polyvinyl alcohol together with the inorganic solid acid.

Though various clay minerals stated above are usable as the inorganic solid acids, it is found that particularly excellent effects have been achieved with use of an inorganic solid acid which is obtained by a semi-synthetic method below.

The inorganic solid acid obtained by the semi-synthetic method is that disclosed in European Patent Publication No. 44,645, and is produced by the steps of acid-treating a clay mineral having a layer-structure composed of regular tetrahedrons of silica until its $SiO_2$ content reaches 82 to 96.5% by weight on dry basis (drying at 105° C. for 3 hours), contacting the resulting clay mineral, in an aqueous medium, with a magnesium and/or aluminum compound or compounds which are at least partially soluble in the aqueous medium, neutralizing the system with an alkali or an acid to form hydroxide when the soluble compound or compounds are other than hydroxides, whereby introducing into the acid-treated clay mineral a magnesium and/or an aluminum component, and drying and pulverizing the product when desired (this solid acid is hereinafter referred to as "semi-synthetic inorganic solid acid").

As stated above among self-contained pressure sensitive record sheets, those of the single layer type have particularly a problem in color smudges when subjected to a contact, friction on the like. In these record sheets of the single layer type, the color forming ability is remarkably improved by use of the above semi-synthetic inorganic solid acid but simultaneously color smudges become significant. However, when the semi-synthetic inorganic solid acid is used in combination with a specific amount of polyvinyl alcohol, the resulting record sheet of the single layer type is extremely improved in color smudge, surprisingly without decreasing the color forming ability so much.

Although the semi-synthetic inorganic solid acid and process for preparing the same are disclosed in detail in the above EP44,645, a brief explanation thereof is set forth below.

Examples of useful clay minerals having a layer-structure composed of regular tetrahedrons of silica are montmorillonite clay minerals, kaolinite clay minerals, sepiolite-palygorskite clay minerals, chlorite clay minerals, vermiculite clay minerals, etc.

The above clay mineral is then intensely acid-treated until its $SiO_2$ content reaches 82 to 96.5% by weight, preferably 85 to 95% by weight, on dry basis (drying at 105° C. for 3 hours).

It is preferred that the above acid treatment should be continued until the acid-treated clay mineral (in dry state) comes to give substantially no diffraction pattern attributable to the crystals having the layer-structure composed of regular tetrahedrons of silica possessed by the untreated clay mineral, when subjected to an X-ray diffraction analysis.

It is particularly preferred, that the acid treatment should be performed until not only the X-ray diffraction analysis but also an electron diffraction analysis of the acid-treated clay mineral can no more substantially show the characteristic diffraction pattern attributable to the crystals of the layer-structure composed of regular tetrahedrons of silica possessed by the untreated clay mineral. The acid treatment can be effected in any known manner, using preferably a mineral acid such as sulfuric, nitric and hydrochloric acids, sulfuric acid being particularly preferred. An organic acid may be used conjointly with those mineral acids.

The clay mineral thus acid-treated is washed with water, and contacted, in an aqueous medium, with a magnesium and/or an aluminum compound which is at least partially soluble in the aqueous medium.

As the magnesium compound, for example, (A) an oxide or hydroxide of magnesium, and (B) an inorganic acid or organic acid salt of magnesium (inorganic acid salt being preferred because of easier removal of the acid radical) can be advantageously used.

Also as the aluminum compound, for example, (C) inorganic acid salts or organic acid salts of aluminum, particularly inorganic acid salts can be favorably used.

As the salts of (B) and (C) above, not only normal salts, but acidic or basic, or complex or double salts may be used. The above magnesium compounds and aluminum compounds may be used as mixtures. Of the above-named salts, chloride, sulfate and nitrate are particularly preferred.

If an inorganic or organic acid salt or salts of magnesium and/or aluminum are used, it is advantageous that those salts should be dissolved, or dispersed, in water; added with the acid-treated and water-washed clay mineral, and neutralized with an alkali to a pH of about 7 to 12, particularly 9 to 11, if a magnesium salt is used; and to a pH of about 4 to 9, preferably 6 to 8, if an aluminum salt is used.

The amount of the magnesium compound and/or aluminum compound to be used is such that, when expressed by atomic ratio, at least one, preferably 3 to 12 of the compound (the sum of magnesium and/or aluminum) are used to 12 of Si in the acid-treated clay mineral.

The desired semi-synthetic inorganic solid acid is obtained by, when desired, drying and pulverizing the above product. It is preferable to pulverize the product to such an extent that at least 80%, particularly at least 90% by weight thereof has a particle size up to 10μ.

It is not necessarily apparent why a conjoint use of a specific amount of polyvinyl alcohol with the inorganic solid acid provides a self-contained type pressure sensitive record sheet of the single layer type which has an excellent color forming ability, reduced susceptibility to color smudges by a contact, friction or the like and yet outstanding in amenability to printing.

However, detailed study by the inventors shows that the inorganic solid acid particles agglomerate when polyvinyl alcohol is used conjointly with the inorganic solid acid. It is presumed that the excellent effects of the invention are greatly attributable to the agglomerates of the inorganic solid acid particles.

Namely, polyvinyl alcohol is strongly adsorbed by a surface of the inorganic solid acid particle through a hydrogen bond between OH group of polyvinyl alcohol molecular chain and oxygen atom of silicate layer of the inorganic solid acid surface. Consequently, the surface of the inorganic solid acid particles become hydrophobic by being covered with hydrocarbon main chain of the adsorbed polyvinyl alcohol. Thus, it is assumed that the inorganic solid acid particles agglomerate by Van der Waals force in order to minimize surface free energy in an aqueous medium.

Agglomerates of the inorganic solid acid particles thus formed are extremely microporous. Therefore, the agglomerates have an excellent ability in adsorption of droplets having a color former dissolved therein, and exhibit an improved color forming ability. Further, agglomerated particles per se function as a stilt material (shock absorbing material) and prevent microcapsules from being destroyed. Thus, it is presumed that two characteristics of color forming ability and resistance to color smudges, which conflict in an antinomic relation, are enhanced in a well balanced relation.

The above semi-synthetic inorganic solid acid is low in bulk density and microflock formed by agglomeration thereof is bulky. Consequently, color forming ability and resistance to color smudges are improved in a more well balanced relation compared with a usual inorganic solid acid. Therefore, the semi-synthetic inorganic solid acid is used particularly favorably in the invention.

Degree of agglomeration of the inorganic solid acid particles greatly depends on a polymerization degree of polyvinyl alcohol and amounts thereof to be added. It is preferable in the invention to selectively use polyvinyl alcohol having a polymerization degree of 400 to 2400, more preferably 500 to 1700. Preferable amount ranges in 10 to 30% by weight based on the weight of the inorganic solid acid. With less than 400 in a polymerization degree of polyvinyl alcohol, or less than 10% by weight in amounts, the inorganic solid acid particles do not agglomerate sufficiently. With more than 2400 in a polymerization degree, or more than 30% by weight in amounts, the coating composition is difficult to be handled due to an increased viscosity thereof.

Various kinds of polyvinyl alcohols can selectively be used such as a perfectly saponified one, partially saponified one, saponified one in block areas (acetyl groups remain in blocks in the molecule), sulfonated polyvinyl alcohol, carboxy-modified polyvinyl alcohol or like modified polyvinyl alcohols.

The color former to be used in this invention for preparing the contemplated record sheets can be any of various dyes. Examples of useful dyes are:

Triarylmethane-based dyes, e.g., 3,3-bis(p-dimethylaminophenyl)-6-dimethylaminophthalide (hereinafter referred to as "crystal violet lactone"), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2dimethylindole-3-yl)-5-dimethylaminophthalide, 3,3-bis-(1,2-dimethylindole-3-yl)-6-dimethylaminophthalide, 3,3-bis(9-ethylcarbazole-3-yl)-6-dimethylaminophthalide, 3,3-bis(2-phenylindole-3yl)-6-dimethylaminophthalide, 3-p-dimethylaminophenyl-3-(1-methylpyrrole-3-yl)-6dimethylaminophthalide and N-n-butyl-3-[bis{4-(N-methylanilino)phenyl}methyl]-carbazole;

Diphenylmethane-based dyes, e.g., 4,4'-bis-dimethylaminiobenzhydryl benzyl ether, N-halophenyl-leucoauramine and N-2,4,5-trichlorophenyl-leucoauramine;

Lactam-based dyes, e.g., rhodamine-B-anilinolactam, rhodamine-(p-nitroanilino )lactam and rhodamine-(o-chloroanilino)lactam;

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluran, 3-diethylamino-6-methyl-7-chlorofluoran, 3-diethylamino-6,7-dimethylfluoran, 3-diethylamino-7-(N-acetyl-N-methylamino)fluoran, 3-diethylamino-7-methylaminofluoran, 3,7-diethylaminofluoran, 3-diethylamino-7-dibenzylaminofluoran, 3-diethylamino-7-(N-methyl-N-benzylamino)fluoran, 3-diethylamino-7-(N-chlorethyl-N-methylamino)fluoran, 3-diethylamino-7-diethylaminofluoran, 3-(N-ethyl-p-toluidino)-7(N-methylanilino)fluoran, 3-(N-ethyl-p-toluidino)-7-methylfluoran, 3-diethylaminobenz(C)fluoran, 2-mesidino-8-diethylaminobenz(C)fluoran, 3-diethylamino-5-methyl-7-dibenzylaminofluoran, 3-chloro-6-cyclohexylaminofluoran, 3-diethylamino-7-cyclohexylaminofluoran, 3-diethylamino-7-(N-cyclohexyl-N-benzylamino)fluoran, 3-(N-ethyl-p-toluidino)-6-methyl-7-anilinofluoran, 3-(N-ethyl-N-cyclopentylamino)-6-methyl-7-anilinofluoran, 3-(N-ethyl-p-toluidino)-6-methyl-7-p-toluidinofluoran and 3-(N-cyclohexyl-N-methylamino)-6-methyl-7-anilinofluoran;

Thiazine-based dyes, e.g., benzoyl-leucomethyleneblue and p-nitrobenzoyl-leucomethyleneblue;

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthypyran, 3-methyl-naphtho-(6'-methoxybenzo)spiropyran and 3-pyropylspiro-dibenzopyran.

According to the invention, the color former is dissolved or dispersed in various nonvolatile organic solvents which are not particularly limited. At least one of organic solvents which are usually used for microcapsules for pressure sensitive manifold papers is usable. Examples of solvents generally useful are petroleum, kerosene, xylene, toluene and like mineral oils, and hydrogenated terphenyl, alkylnaphthalene, alkylated diphenylalkane, alkylated triphenylethene, alkylated diphenyl and like aromatic hydrocarbons. Aliphatic hydrocarbons, alcohols, ketones and esters are also usable as admixed with such solvents.

To the oily solution dissolved or dispersed the color former therein can be added optionally auxiliary agents such as a ultraviolet absorbent, etc. The oily solution containing the color former is microencapsulated by various methods stated below to afford a microcapsule dispersion containing the color former.

In the self-contained type pressure sensitive record sheet of the invention, microcapsules containing the color former are prepared by various suitable processes which are useful for producing conventional pressure sensitive record sheets, such as complex coacervation processes, simple coacervation processes, in-situ polymerization processes and interfacial polymerization processes.

The coacervation processes include those using two components, such as gelatin and gum arabic, or gelatin and carboxymethyl cellulose, those using three components, such as gelatin, carboxymethyl cellulose and methyl vinyl ether-maleic anhydride copolymer, or like complex coacervation process, and microcapsulation process wherein polyvinyl alcohol having a cloud point is used, or like simple coacervation process.

Urea-formaldehyde resin, or melamine-formaldehyde resin, for example, are used for in-situ polymerization processes.

Interfacial polymerization processes use, for example, acid chloride and amine, polyisocyanate and water, polyisocyanate and polyamine, polyisocyanate and polyol, isothiocyanate and water, isothiocyanate and polyamine, and isothiocynate and polyol.

In the invention, although microcapsules containing the color former can be prepared by various microencapsulation processes as stated above, those obtained by a process in which capsule wall film is made of synthetic high polymer, such as in-situ polymerization process, interfacial polymerization process, are most suitable to the present self-contained type pressure sensitive record sheet in which microcapsules containing the color former and the inorganic solid acid acceptor are dispersed in the same coating composition and the composition is applied to a substrate. In those processes, microcapsules are considerably high in wall film strength and excellent in capsule stability (resistances to water, heat, light, etc).

Examples of polyisocynate compounds useful in interfacial polymerization are triphenyldimethylene triisocyanate, tetraphenyltrimethylene tetraisocyanate, pentaphenyltetramethylene pentaisocynate, tolylene diisocyanate, xylene diisocyanate and like aromatic polyisocyanate, trimethylene diisocyanate, hexamethylene diisocyanate, propylene-1,2-diisocyanate, butylene-1,2-diisocyanate, ethylidene diisocyanate, hexatriacontamethylene diisocyanate, polyisocyanate prepolymers which are addition products of these isocyanates with polyhydroxy compounds, polyamines, polycarboxylic acids, polythiols or epoxy compounds, and trimers of aliphatic polyisocyanates such as ethylene diisocyanate, decamethylene diisocyanate, lysine diisocyanate, trimethylhexamethylene diisocyanate and hexamethylene diisocyanate, the trimers being represented by the structural formula

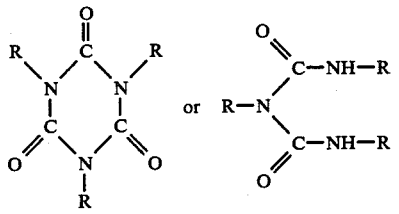

wherein R is an aliphatic group having at least one isocyanate group. Aliphatic polyisocyanates, such as lysine ester triisocyanate, 4-isocyanatomethyl-1,8-octamethylene diisocyanate, 1,3,6-hexamethylene triisocyanate, 4-isocyanatomethyl-1,8-octamethylene diisocyanate, fluorine-containing diisocyanate such as a compound having a structural formula $OCNCH_2(CF_2)_4CH_2NCO$, are also useful.

Useful polyamines are any of those which have at least two —NH or —$NH_2$ groups in the molecule and which are soluble or dispersible in hydrophilic liquids forming a continuous phase. Examples of useful polyamines are aliphatic polyamines such as diethylenetriamine, triethylenetetramine, 1,3-propylenediamine and hexamethylenediamine; adducts of aliphatic polyamines and epoxy compounds; alicyclic polyamines such as piperazine; and heterocyclic diamines such as 3,9-bis-aminopropyl-2,4,8,10-tetraoxaspiro-[5,5]-undecane.

As stated above, the inorganic solid acid particles are presumed to agglomerate by use of polyvinyl alcohol. When the microcapsule itself contains polyvinyl alcohol, the polyvinyl alcohol contributes to agglomerate inorganic solid acid particles. Thus, the particle adheres to capsule surface and improve the color forming ability. Moreover, since capsules are also prevented to be destroyed excessively, resistance to color smudges is enhanced very effectively.

In the invention, to the coating composition comprising microcapsules containing color former, inorganic solid acid acceptor and polyvinyl alcohol are added, when desired, various auxiliary agents such as latexes, starches and like adhesives, starch particles, cellulose powder and like stilt materials, pigments, dyes, etc.

Substrates to be coated with the coating composition are not particularly limited. Examples of preferable substrates are paper, synthetic paper, synthetic film, etc. The coating composition is applied to a substrate or finished without limited to any means, and various means can be adopted.

The present invention will be described in greater detail with reference to the following examples, to which the invention is not limited. The parts and percentages in the examples are all by weight.

EXAMPLE 1

(1) Preparation of Dispersion of Microcapsules Containing Color Former

Into 100 parts of diisopropylnaphthalene were dissolved 3 parts of crystal violet lactone, 0.5 part of N-n-butyl-3-[bis{4-(N-methylanilino)phenyl}methyl]-carbazole and 0.1 part of rhodamine-B-anilinolactam. Further dissolved in the oily solution were 4 parts of an aromatic polyisocyanate (trade name "Millionate MR-500", product of Nihon Polyurethane Co., Ltd.) and 8 parts of trimer of an aliphatic polyisocyanate, namely, hexamethylene diisocyanate having a biuert bond. The resulting oily solution was emulsified with 300 parts of 2% aqueous solution of polyvinyl alcohol (trade name "PVA-117, product of Kuraray Co., Ltd., saponification degree 98 to 99%, polymerization degree 1700) using a homomixer to obtain a dispersion of particles 10μ in mean size. To the dispersion was added 2 parts of a polyamine adduct of bisophenol A, epichlorohydrin and alkylamine. The mixture was stirred at room temperature for 15 minutes, thereafter reacted at an elevated temperature of 90° C. for 4 hours and subsequently cooled to room temperature to prepare a dispersion of microcapsules containing the color former.

(2) Preparation of Dispersion of Color Acceptor

Into 200 parts of water was dissolved 0.1 part of sodium pyrophosphate. In the solution was thoroughly dispersed 100 parts of "semi-synthetic inorganic solid acid " (trade name "Silton SS-1", product of Mizusawa Kagaku Kogyo KK). To the dispersion were added 15 parts of 20% aqueous solution of oxidized starch and 30 parts of styrene-butadiene copolymer latex (50% solids) to obtain a dispersion of the color acceptor.

(3) Preparation of Self-Contained Type Pressure Sensitive Record Sheet of the Single Layer Type.

The microcapsule dispersion containing color former (100 parts, calculated as solids), 150 parts (calculated as solids) of the color acceptor dispersion, 300 parts of 10% aqueous solution of polyvinyl alcohol having a saponification degree of 87 to 89% and polymerization degree of 1700 (trade name "PVA- 217", product of Kuraray Co., Ltd.) and 80 parts of a pulp powder were mixed together to obtain a uniform coating composition. The composition was applied in the form of a single layer to a substrate in an amount of 10 g/m$^2$ (dry weight) by air knife coating to obtain a self-contained type pressure sensitive record sheet.

EXAMPLE 2

(1) Preparation of Dispersion of Microcapsules Containing Color Former

Into 120 parts of water was dissolved 25 parts of 20% aqueous solution of sodium poly-2-acrylamide-2-methyl-propanesulfonate. The aqueous solution was adjusted to a pH of 4.5 by adding phosphoric acid thereto and was heated to 60° C. A solution of 3 parts of crystal violet lactone, 0.5 part of N-n-butyl-3-[bis{4-(N-methylanilino)phenyl}methyl]carbazole and 0.1 part of rhodamine-B-anilinolactam in 100 parts of diisopropylnaphthalene was added to the above aqueous solution, and the mixture was treated with use of a homomixer for emulsification to prepare a dispersion of particles 4.5μ in mean size. Separately, into 20 parts of water was dissolved 15 parts of water-soluble precondensate obtained from one mole of melamine and 5.25 moles of formaldehyde which contained about 2.3 $OCH_3$ groups per molecule of melamine, and the solution was adjusted to a pH of 4.5 and heated to 60° C. The solution was added to the above dispersion and the mixtue was reacted at 60° C. for 4 hours. The mixture was cooled and adjusted to a pH of 7.0, and thereto added 3 parts of ethyleneurea. The mixture was stirred at room temperature for 24 hours to prepare a dispersion of microcapsules containing the color former.

(2) Preparation of Dispersion of Color Acceptor

Into 300 parts of water was dissolved 0.5 part of sodium phrophosphate. In the solution was thoroughly dispersed 100 parts of activated clay and 4 parts of sodium hydroxide. To the dispersion was added 20 parts of styrene-butadiene copolymer latex (50% solids) to obtain a dispersion of the color acceptor.

(3) Preparation of Self-Contained Type Pressure Sensitive Record Sheet of the Single Layer Type.

The microcapsule dispersion containing color former (100 parts, calculated as solids), 120 parts (calculated as solids) of the color acceptor dispersion, 100 parts of 20% aqueous solution of polyvinyl alcohol having a saponification degree of 87 to 89% and polymerization degree of 500 (trade name "PVA-205", product of Kuraray Co., Ltd.) and 60 parts of a pulp powder were mixed together to obtain a uniform coating composition. The composition was applied in the form of a single layer to a substrate in an amount of 11 g/m$^2$ (dry weight) by air knife coating to obtain a self-contained type pressure sensitive record sheet.

EXAMPLE 3

(1) Preparation of Dispersion of Microcapsules Containing Color Former

One hundred parts of 3 % aqueous solution of ethylene-maleic anhydride copolymer, 10 parts of urea and 1 part of resorcin were dissolved in 200 parts of water, and the solution was adjusted to a pH of 3.3 with 20% aqueous solution of sodium hydroxide. A solution of 3 parts of crystal violet lactone, 0.5 part of N-n-butyl-3-[bis{4-(N-methylanilino)phenyl}methyl]carbazole and 0.1 part of rhodamine-B-anilinolactam in 100 parts of diisopropylnaphthalene was added to the above solution, and the mixture was treated with use of a homomixer for emulsification to prepare a dispersion of particles 4.6μin mean size. Twenty-five parts of 37% aqueous solution of formaldehyde was added to the dispersion. The mixture was heated to 55° C. with stirring, maintained at this temperature for 3 hours and thereafter cooled to obtain a capsule dispersion containing the color former.

(2) Preparation of Dispersion of Color Acceptor

Into 200 parts of water was dissolved 1.0 part of sodium pyrophosphate. In the solution was thoroughly dispersed 100 parts of "semi-synthetic inorganic solid acid". To the dispersion were added 0.5 part of carboxymethyl cellulose and 40 parts of styrene-butadiene copolymer latex (50% solids) to obtain a dispersion of the color acceptor.

(3) Preparation of Self-Contained Type Pressure Sensitive Record Sheet of the Single Layer Type.

The microcapsule dispersion containing color former (100 parts, calculated as solids), 130 parts (calculated as solids) of the color acceptor dispersion, 250 parts of 10% aqueous solution of polyvinyl alcohol having a saponification degree of 98 to 99% and polymerization degree of 1500 (trade name "PVA-115", product of Kuraray Co., Ltd.) and 70 parts of a pulp powder were mixed together to obtain a uniform coating composition. The composition was applied in the form of a single layer to a substrate in an amount of 10 g/m$^2$ (dry weight) by air knife coating to obtain a self-contained type pressure sensitive record sheet.

EXAMPLE 4

(1) Preparation of Dispersion of Microcapsules Containing Color Former

Three parts of crystal violet lactone, 0.5 part of N-n-butyl-3-[bis{4-(N-methylanilino)phenyl}methyl]carbazole and 0.1 part of rhodamine-B-anilinolactam were dissolved in 100 parts of diisopropylnaphthalene. Further dissolved in the oily solution were 6 parts of an aromatic polyisocyanate, namely, polymethylenepolyphenyl isocyanate (trade name "MILLIONATE MR-500", product of Nihon Polyurethane Co., Ltd.) and 6 parts of lysine diisocyanate $\beta$-isocyanate ethyl ester (trade name "T-100", product of Toray Industries, Inc.). The resulting oily solution was emulsified with 200 parts of 4% aqueous solution of polyvinylbenzenesulfonic acid partly converted to sodium salt (trade name "VERSA TL-500", product of National Starch and Chemical Corp.) using a homomixer to obtain a dispersion of particles 9$\mu$ in mean size. One part of diethylenetriamine and 0.2 part of hexamethylenediamine were added to the dispersion. The mixture was stirred at room temperature for 15 minutes, thereafter reacted at an elevated temperature of 80° C. for 4 hours and subsequently cooled to room temperature to prepare a dispersion of micro-capsules containing the color former.

(2) Preparation of Dispersion of Color Acceptor

A dispersion of color acceptor was obtained in the same manner as in Example 3.

(3) Preparation of Self-Contained Type Pressure Sensitive Record Sheet of the Single Layer Type The microcapsule dispersion containing color former (100parts, calculated as solids), 150 parts (calculated as solids) of the color acceptor dispersion, 200 parts of 15% aqueous solution of saponified polyvinyl alcohol in block areas, having a saponification degree of 87 to 89% and polymerization degree of 1700 (trade name "PVA-217EE", product of Kuraray Co., Ltd.) and 80 parts of a pulp powder were mixed together to obtain a uniform coating composition. The composition was applied in the form of a single layer to a substrate in an amount of 9 g/m$^2$ (dry weight) by air knife coating to obtain a self-contained type pressure sensitive record sheet.

COMPARISON EXAMPLE 1

A self-contained type pressure sensitive record sheet in the form of a single layer was prepared in the same manner as in Example 1 except that polyvinyl alcohol was not added having a saponification degree of 87 to 89% and a polymerization degree of 1700.

COMPARISON EXAMPLE 2

A self-contained type pressure sensitive record sheet in the form of a single layer was prepared in the same manner as in Example 2 except that polyvinyl alcohol was not added having a saponification degree of 87 to 89% and a polymerization degree of 500.

COMPARISON EXAMPLE 3

A self-contained type pressure sensitive record sheet in the form of a single layer was prepared in the same manner as in Example 3 except that polyvinyl alcohol was not added having a saponification degree of 98 to 99% and a polymerization degree of 1500.

COMPARISON EXAMPLE 4

A self-contained type pressure sensitive record sheet in the form of a single layer was prepared in the same manner as in Example 4 except that saponified polyvinyl alcohol in block areas was not added having a saponification degree of 87 to 89% and a polymerization degree of 1700.

COMPARISON EXAMPLE 5

A self-contained type pressure sensitive record sheet in the form of a single layer was prepared in the same manner as in Example 1 except that 40 parts of polyvinyl alcohol having a saponification degree of 87 to 89% and a polymerization degree of 1700 was added per 100 parts of the inorganic solid acid. In the resulting record sheet, the coating composition was unevenly coated due to its high viscosity.

COMPARISON EXAMPLE 6

A self-contained type pressure sensitive record sheet in the form of a single layer was prepared in the same manner as in Example 4 except that 5 parts (calculated as solids) of saponified polyvinyl alcohol in block areas having a saponification degree of 87 to 89% and a polymerization degree of 1700 was added per 100 parts of the inorganic solid acid.

EXAMPLE 5

The microcapsule dispersion containing color former of Example 1 (100 parts, calculated as solids), 120 parts (calculated as solids) of the color acceptor dispersion of Example 1, 250 parts of 10% aqueous solution of polyvinyl alcohol having a saponification degree of 87 to 89% and polymerization degree of 2000 (trade name "PVA-220", product of Kuraray Co., Ltd.) and 70 parts of a pulp powder were mixed together to obtain a uniform coating composition. The composition was applied in the form of a single layer to a substrate in an amount of 10 g/m$^2$ (dry weight) by air knife coating to obtain a self-contained type pressure sensitive record sheet of the single layer type.

EXAMPLE 6

The microcapsule dispersion containing color former of Example 2 (100 parts, calculated as solids), 150 parts (calculated as solids) of the color acceptor dispersion of Example 3, 150 parts of 20% aqueous solution of polyvinyl alcohol having a saponification degree of 87 to 89% and polymerization degree of 500 (trade name "PVA-205", product of Kuraray Co., Ltd.) and 60 parts of a pulp powder were mixed together to obtain a uniform coating composition. The composition was applied in the form of a single layer to a substrate in an amount of 11 g/m$^2$ (dry weight) by air knife coating to obtain a self-contained type pressure sensitive record sheet of the single layer type.

EXAMPLE 7

The microcapsule dispersion containing color former of Example 3 (100 parts, calculated as solids), 120 parts (calculated as solids) of the color acceptor dispersion of Example 2, 250 parts of 10% aqueous solution of polyvinyl alcohol having a saponification degree of 87 to 89% and polymerization degree of 1700 (trade name "PVA-217", product of Kuraray Co., Ltd.) and 60 parts of a pulp powder were mixed together to obtain a uniform coating composition. The composition was applied in the form of a single layer to a substrate in an amount of 11 g/m$^2$ (dry weight) by air knife coating to obtain a self-contained type pressure sensitive record sheet of the single layer type.

COMPARISON EXAMPLE 7

The microcapsule dispersion containing color former of Example 2 (100 parts, calculated as solids), 150 parts (calculated as solids) of the color acceptor dispersion of Example 3, 150 parts of 20% aqueous solution of polyvinyl alcohol having a saponification degree of 87 to 89% and polymerization degree of 2800 (trade name "PVA-228", product of Kuraray Co., Ltd.) and 60 parts of a pulp powder were mixed together to obtain a uniform coating composition. The composition was applied in the form of a single layer to a substrate in an amount of 10 g/m$^2$ (dry weight) by air knife coating to obtain a self-contained type pressure sensitive record sheet of the single layer type. The coating composition was high in viscosity, thus the resulting record sheet was low in commercial value since the composition was unevenly coated.

COMPARISON EXAMPLE 8

A self-contained type pressure sensitive record sheet of the single layer type was prepared in the same manner as in Example 5 except that polyvinyl alcohol having a saponification degree of 87 to 89% and a polymerization degree of 300 (trade name "PVA-203", product of Kuraray Co., Ltd.) was used in place of polyvinyl alcohol used in Example 5.

The fifteen self-contained type pressure sensitive record sheets in the form of a single layer thus prepared were tested for quality. Table 1 shows the results.

TABLE 1

| | Record density | Press smudge | Friction smudge |
|---|---|---|---|
| Ex. 1 | 0.82 | 0.13 | A |
| Ex. 2 | 0.80 | 0.11 | A |
| Ex. 3 | 0.81 | 0.12 | A |
| Ex. 4 | 0.84 | 0.12 | A |
| Ex. 5 | 0.83 | 0.13 | A |
| Ex. 6 | 0.84 | 0.13 | A |
| Ex. 7 | 0.76 | 0.11 | A |
| Com. Ex. 1 | 0.90 | 0.22 | C |
| Com. Ex. 2 | 0.71 | 0.19 | B |

TABLE 1-continued

| | Record density | Press smudge | Friction smudge |
|---|---|---|---|
| Com. Ex. 3 | 0.87 | 0.23 | C |
| Com. Ex. 4 | 0.92 | 0.21 | C |
| Com. Ex. 5 | 0.73 | 0.18 | A |
| Com. Ex. 6 | 0.91 | 0.20 | C |
| Com. Ex. 7 | 0.75 | 0.19 | A |
| Com. Ex. 8 | 0.88 | 0.20 | B |

NOTE

Record density

The sheet was struck with a 2 mm square flat-faced type at a high pressure using a typewriter (HERMES-700EL). The density of color formed was measured 3 hours after the typewriting by a Macbeth densitometer with use of a red filter. The larger the value, the better is the amenability to recording.

Press smudge

The density of color smudge produced on the sheet by a press at a pressure of 60 kg/cm$^2$ was measured by a Macbeth densitometer with use of a red filter. The larger the value, the more susceptible is the sheet to press smudging.

Friction smudge

A sheet of wood free paper was superposed on the coated surface of the record sheet, and the sheets were rubbed five times under a load of 300 g/cm$^2$. The color smudge formed on the record sheet was inspected with the unaided eye.

A: almost no smudge

B: slight smudge

C: marked smudge

Table 1 shows that the present self-contained pressure sensitive record sheets are excellent in color forming ability, have reduced susceptibility to color smudges when subjected to a contact, friction or the like and have particularly excellent qualities high in commercial values.

We claim:

1. A self-contained type pressure sensitive record sheet prepared by coating a substrate with a mixture of microcapsules containing a color former and an inorganic solid acid as a color acceptor and drying the resulting coating, the mixture containing 10 to 30% by weight of polyvinyl alcohol based on the weight of the inorganic solid acid, said polyvinyl alcohol having a polymerization degree of 400 to 2400.

2. A self-contained type pressure sensitive record sheet as defined in claim 1 wherein the inorganic solid acid is a solid acid produced by the steps of acid-treating a clay mineral having a layer-structure composed of regular tetrahedrons of silica until its $SiO_2$ content reaches 82 to 96.5% by weight on dry basis (drying at 105° C. for 3 hours), contacting the resulting clay mineral, in an aqueous medium, with a magnesium and/or aluminum compound or compounds which are at least partially soluble in the aqueous medium, neutralizing the system with an alkali or an acid to form hydroxide when the soluble compound or compounds are other than hydroxides, whereby introducing into the acid-treated clay mineral a magnesium and/or an aluminum component, and drying and pulverizing the product when desired.

3. A self-contained type pressure sensitive record sheet as defined in claim 1 wherein polyvinyl alcohol has a polymerization degree of 500 to 1700.

* * * * *